US010994962B2

(12) United States Patent
Bez

(10) Patent No.: US 10,994,962 B2
(45) Date of Patent: May 4, 2021

(54) MANUAL DEVICE FOR APPLYING A COATING TO A SUPPORT BY MEANS OF TAPE

(71) Applicant: SOCIETE BIC, Clichy (FR)

(72) Inventor: Arnaud Bez, Garches (FR)

(73) Assignee: Société BIC, Clichy (FR)

( * ) Notice: Subject to any disclaimer, the term of this patent is extended or adjusted under 35 U.S.C. 154(b) by 0 days.

(21) Appl. No.: 16/648,461

(22) PCT Filed: Sep. 17, 2018

(86) PCT No.: PCT/FR2018/052266
§ 371 (c)(1),
(2) Date: Mar. 18, 2020

(87) PCT Pub. No.: WO2019/058049
PCT Pub. Date: Mar. 28, 2019

(65) Prior Publication Data

US 2020/0223654 A1 Jul. 16, 2020

(30) Foreign Application Priority Data

Sep. 20, 2017 (FR) ..... 17 58718

(51) Int. Cl.
*B65H 35/00* (2006.01)
*B65H 37/00* (2006.01)

(52) U.S. Cl.
CPC ..... *B65H 35/004* (2013.01); *B65H 37/007* (2013.01); *B65H 2301/33222* (2013.01)

(58) Field of Classification Search
CPC ..... B65H 37/007; Y10T 156/1795; Y10T 156/1365; Y10T 156/18; Y10T 156/1348
See application file for complete search history.

(56) References Cited

U.S. PATENT DOCUMENTS 5,006,184 A * 4/1991 Manusch ..... B65H 37/007 156/577
6,360,805 B1 * 3/2002 Takahashi ..... B65H 37/007 118/257

(Continued)

FOREIGN PATENT DOCUMENTS

EP 1059258 A2 12/2000

OTHER PUBLICATIONS

International Search Report and Written Opinion dated Dec. 4, 2018 in counterpart International Patent Application No. PCT/FR2018/052266 (10 pages).

*Primary Examiner* — Alex B Efta
(74) *Attorney, Agent, or Firm* — Bookoff McAndrews, PLLC

(57) ABSTRACT

A manual device for applying a coating to a support by means of tape, in which a first angle formed between the median plane of the applicator tip and the half-line extending from the middle of the application edge of the applicator tip and passing through the point arranged at the intersection of the outer periphery of the first winding and the radius of the first winding perpendicular to the median plane, is between −1° and 10°, whereas a second angle formed between the median plane and the half-line extending from the middle of the application edge and passing through the point arranged at the intersection of the outer periphery of the second winding and the radius of the second winding perpendicular to the median plane, is between 1° and 10°.

13 Claims, 3 Drawing Sheets

(56) References Cited

U.S. PATENT DOCUMENTS

| | | | |
|---|---|---|---|
| 2012/0048476 | A1 | 3/2012 | Stoll |
| 2012/0168090 | A1 | 7/2012 | Kropp |
| 2012/0168547 | A1 | 7/2012 | Kropp |

* cited by examiner

MANUAL DEVICE FOR APPLYING A COATING TO A SUPPORT BY MEANS OF TAPE

CROSS REFERENCE TO RELATED APPLICATION(S)

This application is a National Stage Application of International Application No. PCT/FR2018/052266, filed on Sep. 17, 2018, now published as WO2019/058049, and which claims priority to French Application No. FR1758718, filed on Sep. 20, 2017.

TECHNICAL FIELD

The disclosure concerns the field of manual devices for applying a coating to a support by means of tape. These devices are sometimes known by the name of "mouse" or "tape applicator" and are used mainly, but not exclusively, in the office field. The coating can be, for example, glue or a white or colored coating.

PRIOR ART

Among the known manual devices of application by tape, the coating carried by the tape is often damaged before its application, particularly while the tape is travelling from the supply reel to the applicator tip. A need therefore exists in this regard.

SUMMARY

One aspect concerns a manual device for applying a coating to a support by means of tape comprising a supply reel mounted on a first bearing and comprising a first tape winding, a take-up reel mounted on a second bearing and comprising a second tape winding, and an applicator tip to apply the coating carried by the tape onto a support, the applicator tip extending in a longitudinal direction and having an application edge, the application edge and the longitudinal direction defining an application plane while the plane perpendicular to the application plane extending in the longitudinal direction and passing through the middle of the application edge forms the median plane of the applicator tip, in which the angle between the axis of each of the first and second bearings and the application plane is greater than or equal to 30° (thirty degrees of angle), the first bearing and the second bearing are arranged on either side of the median plane of the applicator tip and, considered projecting into the application plane, a first angle formed between the median plane and the half-line extending from the middle of the application edge and passing through the point arranged at the intersection of the outer periphery of the first winding and the radius of the first winding perpendicular to the median plane, is between −1° and 10° (minus one degree of angle and ten degrees of angle) whereas a second angle formed between the median plane and the half-line extending from the middle of the application edge and passing through the point arranged at the intersection of the outer periphery of the second winding and the radius of the second winding perpendicular to the median plane, is between 1° and 10° (one degree of angle and ten degrees of angle).

Subsequently, and unless stated otherwise, a "manual device" means a "manual device for applying a coating to a support by means of tape."

Clearly, the tape is continuous from the first winding carried by the supply reel to the second winding carried by the take-up reel. It will be understood that the tape travels from the supply reel to the tip, passes around the application edge and then travels from the tip to the take-up reel. Generally, upstream and downstream are defined by the normal direction of travel of the tape from the supply reel (which carries the first winding) to the take-up reel (which carries the second winding). It will be understood that the portion of tape inside the first winding carries the coating while the second winding is substantially formed by the used tape, that is to say the tape that is, totally or partially, devoid of coating. Clearly, the starts of the windings may have no coating at all or, by contrast, have a new coating.

It will be understood that the manual device has a case housing the reels (with the windings and bearings) and the applicator tip. At least in the use position, the applicator tip protrudes from the case. The longitudinal direction of the applicator tip is the direction in which the tip protrudes from the case in the position of use. Clearly, the application edge is straight and forms an angle with the longitudinal direction. For example, the application edge is perpendicular to the longitudinal direction, but not necessarily. The longitudinal direction and the application edge define a plane, called the application plane. The median plane is the plane that passes through the middle of the application edge and extends in the longitudinal direction while being perpendicular to the application plane.

In order to measure the angle between the axis of each of the bearings and the application plane, the smallest angle formed between these two geometric elements is always considered. According to one embodiment, the axes of the bearings are perpendicular to the application plane or, in other words, the axes of the bearings are parallel to the median plane. In order to determine the position of the bearings in relation to the median plane, the middle of the bearing is considered in the direction of the axis of the bearing, while projecting into the axis of the bearing, as a point of reference.

It will therefore be understood that in order to travel from the first winding (or from the supply reel) to the application edge, the tape undergoes a first twist or spiral. Similarly, in order to travel from the application edge to the second winding (or to the take-up reel) the tape undergoes a second twist or spiral, that can be similar to the first twist or spiral, but not necessarily.

Such a manual device is therefore of the "lateral application" type, that is to say, for which the axis of rotation of the reels is substantially perpendicular to the application plane (i.e. forms an angle of between 30° and 90° with the application plane). In contrast to lateral application manual devices, there are "front application" type manual devices for which the axis of rotation of the reels is substantially parallel to the application plane (i.e. forms an angle of between 0° and 30° with the application plane). The main difference for the user between these two types of manual devices is how they are held, the application using these two types of manual devices being more or less intuitive for the user.

In order to measure the angles between the half-lines and the median plane, the point of reference to be considered within a tape winding is the point arranged at the intersection of the outer periphery of the winding considered and the radius of the winding considered perpendicular to the median plane, in the middle in the direction of the axis of the winding considered (i.e. the middle of the width of the winding/tape).

Furthermore, in order to measure the orientation of the first and second angle, a check must be performed to determine whether the half-line defining the angle in question with the median plane extends on the same side as the corresponding bearing (i.e. the first bearing for the first angle and the second bearing for the second angle) in relation to the median plane. Thus, if the half-line extends on the same side as the corresponding bearing in relation to the median plane, then the angle is positive. If the half-line extends on the side opposite the corresponding bearing in relation to the median plane, then the angle is negative.

Clearly, as the manual device is used, the diameter of the first winding decreases, so that the first angle increases, while the diameter of the second winding increases, so that the second angle decreases. However, the first angle remains between −1° and 10° and the second angle remains between 1° and 10°, whatever the state of the windings. It is thus ensured that the tape, although having a certain twist or spiral, preserves a certain alignment in the longitudinal direction with the applicator tip throughout the lifetime or duration of use of the manual device.

Such a configuration makes it possible to minimize the stresses to which the tape between the windings and tip is subjected, which preserves the integrity of the coating before application. Furthermore, this configuration does away with elements for guiding and aligning the tape with the applicator tip such as those found in state of the art manual devices; this avoids imposing frictional stress on the tape and affords the user a more free-flowing application. The travel of the tape is thus more natural, including at the applicator tip. This also frees up space inside the manual device compared to state of the art manual devices. It is thus possible to provide a larger quantity of tape, which gives the manual device a longer life.

In certain embodiments, the tape cooperates only with the supply reel, the take-up reel and the applicator tip.

In other words, the manual device has no guide elements apart from those that may be present inside the supply reel, take-up reel and applicator tip.

This minimizes the stresses undergone by the tape, while guaranteeing that a minimum amount of space is occupied within the manual device, which maximizes the quantity of tape that it can contain.

In some embodiments, the applicator tip comprises a guide portion having a first twisted surface and a second twisted surface, the first twisted surface cooperating with the tape downstream of the supply reel and upstream of the application edge while the second twisted surface cooperates with the tape downstream of the application edge and upstream of the take-up reel, the tape being configured to travel from upstream to downstream within the manual device.

For example, the first twisted surface and the second twisted surface are opposing surfaces of one and the same element of the guide portion. Clearly, according to a variation, the guide portion comprises two distinct elements forming the first twisted surface and the second twisted surface respectively. For example, the surfaces are twisted around about the longitudinal direction of the applicator tip.

It will be understood that the guide portion allows the twisting movement undergone by the tape between the windings and the application edge to be at least partially guided and accompanied.

In some embodiments, the first bearing and the second bearing are offset in relation to one another in the longitudinal direction.

As previously, in order to determine the position of the bearings, the middle of the bearing in the direction of the axis of the bearing, projecting into the axis of the bearing, is considered as the point of reference.

Such offsetting of the bearings avoids interference between the two windings, which makes it possible to adjust the position of the bearings in relation to the median plane, for example by bringing them closer to the median plane, so as to ensure an even better alignment in the longitudinal direction of the tape with the applicator tip, whatever the state of the windings. This makes it possible to further reduce the stresses undergone by the tape.

In some embodiments, considered in the longitudinal direction, the second bearing is arranged between the applicator tip and the first bearing.

By choosing the first bearing as the bearing furthest from the applicator tip, the pitch of the twist undergone by the tape coming off the first winding, that is to say the portion of tape having the coating, is minimized. This thus minimizes the stresses undergone by the portion of tape with the coating, which ensures better integrity of the tape. Clearly, it will be understood that the pitch of the twist undergone by the tape that travels from the application edge to the second winding is greater, but remains acceptable, thanks to the alignment in the longitudinal direction of the second winding with the tip, in order to prevent the formation of folds in the tape. Moreover, as the coating has already been deposited, this portion of tape can undergo a greater pitch of twist without risk for the coating.

In some embodiments, the first winding and the second winding are offset in relation to one another in a direction perpendicular to the application plane.

In a similar way to the bearings, the middle of the winding in the direction of the axis of the winding, projecting into the axis of the winding, is taken as the point of reference in order to determine the position of the winding. Similarly, if the position of a reel had to be determined, the middle of the reel in the direction of the axis of the reel, projecting into the axis of the reel, would be considered as the point of reference.

Such offsetting of the bearings prevents interference between the two windings and the tape exiting/entering the windings, which further optimizes the position of the bearings in relation to the median plane and ensures a better alignment in the direction perpendicular to the application plane of each winding, and thus of the tape, with the corresponding portions of the applicator tip. This further reduces the stresses undergone by the tape.

In some embodiments, the first winding is offset in relation to the second winding on the side of the first twisted surface whereas the second winding is offset in relation to the first winding on the side of the second twisted surface.

Such a configuration enables the windings to be even better positioned in relation to the applicator tip, which further reduces the stresses undergone by the tape.

BRIEF DESCRIPTION OF THE DRAWINGS

A better understanding of the disclosure will emerge more clearly from the following detailed description of various embodiments given by way of non-limiting examples. This description refers to the pages of accompanying Figures, in which.

DETAILED DESCRIPTION

Figure 1:
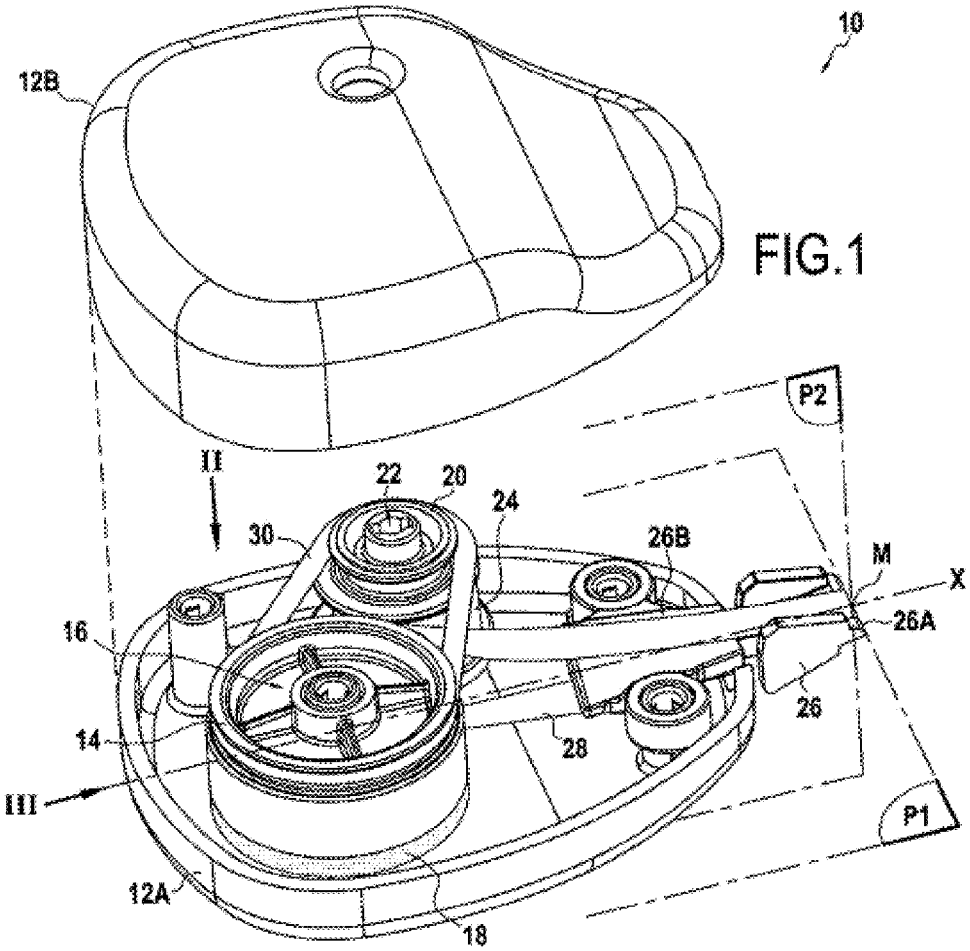
FIG. 1 shows a manual device for applying a coating to a support by means of tape, seen in perspective, with the case open.

FIG. 1 shows a manual device 10 for applying a coating to a support by means of tape comprising a case having, in this embodiment, a first part of the case 12A and a second part of the case 12B, the case receiving a supply reel 14 mounted on a first bearing 16 and comprising a first winding of tape 18, a take-up reel 20 mounted on a second bearing 22 and comprising a second winding of tape 24 and an applicator tip 26. In this embodiment, the supply reel 14 and take-up reel 20 are coupled in rotation by a band 30, but clearly any other means of coupling these two reels in rotation can be envisaged. Similarly, in this embodiment the bearings 16 and 22 are formed by spindles integral with the first part of the case 12A, but any other configuration can be envisaged. For example, the bearings can be integral with a refill cartridge, forming a distinct piece of the case.

The applicator tip 26 has an application edge 26A and a guide portion 26B. The tape 28 extends, from upstream to downstream, from the first winding 18 (or supply reel 14) to the application edge 26A, rounds the application edge 26A and then extends from the application edge 26A to the second winding 24 (or take-up reel 20). The arrows in FIG. 5B are oriented from upstream to downstream and indicate the direction of travel of the tape 28. In this embodiment, the tape 28 cooperates only with the supply reel 14, the applicator tip 26 and the take-up reel 20.

The tape 28 has a coating 19 upstream of the application edge 26A. As the application edge 26A allows the coating 19 to be deposited on a support (not shown), the tape 28 no longer has any coating 19 downstream of the application edge 26A. Clearly, the tape 28 downstream of the application edge 26A can in certain cases have a coating, for example because the tape 28 has travelled without application, or because there is a fault during application.

The applicator tip 26 extends in a longitudinal direction X. The longitudinal direction X and the application edge 26A (which is straight) define the application plane P1. In other words, the application plane P1 comprises the application edge 26A and extends in the longitudinal direction X. The plane P2 is perpendicular to the application plane P1, extends in the longitudinal direction X and passes through the middle M of the application edge 26A. This plane P2 forms the median plane of the applicator tip 26.

Figure 4:
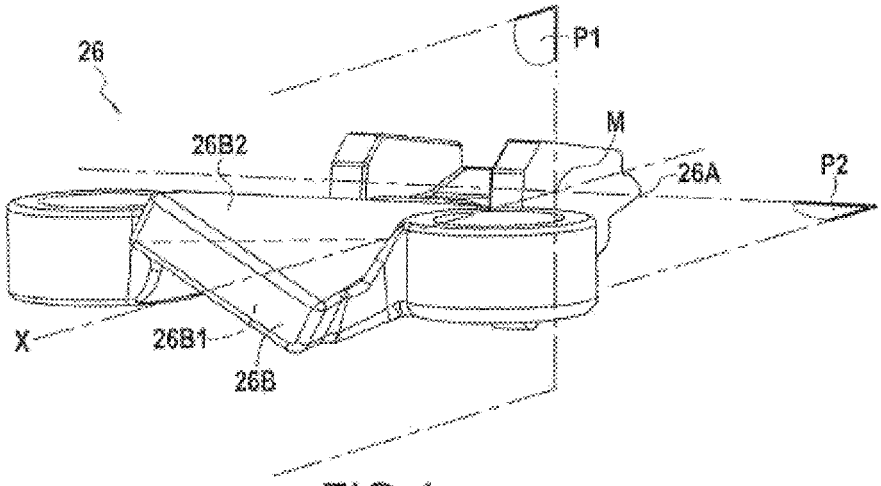
FIG. 4 shows the applicator tip of the manual device in FIG. 1, seen in perspective.
Figure 5A:
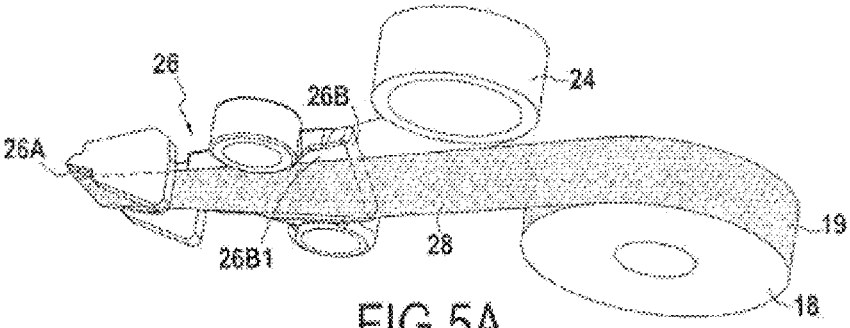
FIGS. 5A and 5B show the path travelled by the tape from the first winding to the second winding, within the manual device shown in FIG. 1.
Figure 5B:
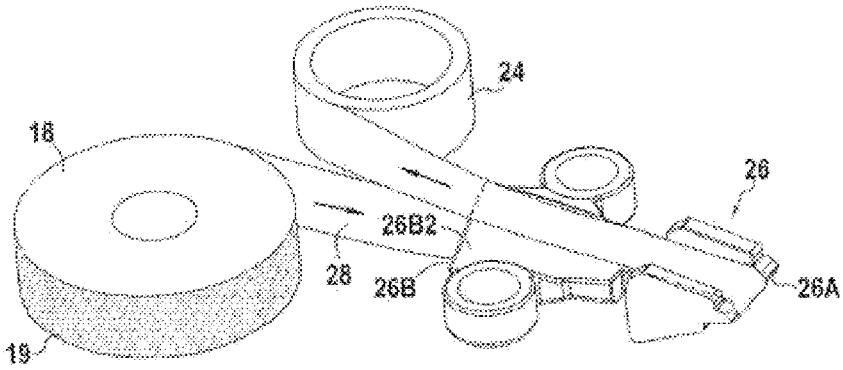

With reference to FIGS. 4, 5A and 5B, the guide portion 26B of the applicator tip 26 has a first twisted surface 26B1 and a second twisted surface 26B2. The first twisted surface 26B1 cooperates with the tape 28 downstream of the first winding 18 and upstream of the application edge 26A. The second twisted surface 26B2 cooperates with the tape 28 downstream of the application edge 26A and upstream of the second winding 24. In this embodiment, the twisted surfaces 26B2 and 26B1 are substantially parallel and formed by two opposing faces of one and the same element. More particularly, the guide portion 26B is formed in this embodiment by a blade extending in the longitudinal direction X and twisted about the longitudinal direction X. In this embodiment, the pitch of the twist is 2.5°/cm (two and five tenths degrees of angle per centimeter). Moreover, the width of the guide portion is approximately equal to 135% of the width of the tape 28. This enables maximum accompaniment of the tape within the applicator tip when there are variations in diameter of the windings during the lifetime of the product.

Figure 3:
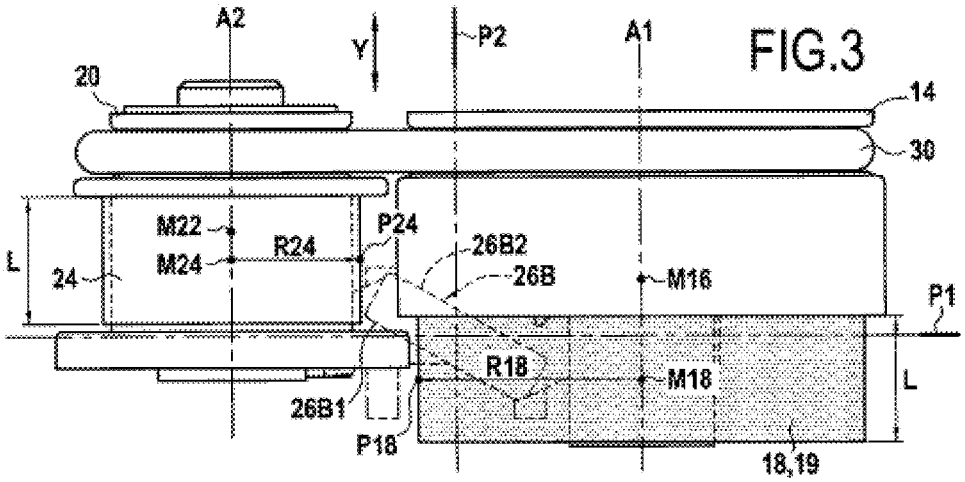
FIG. 3 shows the manual device, without the case, seen along Arrow III in FIG. 1.

As shown in FIG. 3, in this embodiment, the axes A1 and A2 of the first and second bearings 16 and 22 are perpendicular to the application plane P1. In other words, the axes A1 and A2 each form an angle with the application plane P1 greater than or equal to 30°. As the windings 18 and 24, the reels 14 and 22 and the bearings 16 and 22 are respectively coaxial, the tape 18 thus undergoes in this embodiment a twisting movement of 90° from the first winding 18 to the application edge 26A. Similarly, the tape 18 undergoes a twisting movement of 90° from the application edge 26A to the second winding (see FIGS. 5A and 5B).

The middles M16 and M22 of the first and second bearings 16 and 22 in the direction of the axes A1 and A2 and projecting into axes A1 and A2 respectively are arranged on either side of the median plane P2. Thus, the first and second bearings 16 and 22 are arranged on either side of the median plane P2. This can also be seen in FIGS. 2A and 2B. Moreover, with reference to FIGS. 2A and 2B, the middles M16 and M22 are offset in relation to one another in the longitudinal direction X. Thus, the first and second bearings 16 and 22 are offset in relation to one another in the longitudinal direction X. More particularly, in this embodiment, the second bearing 22 is arranged, in the longitudinal direction X, between the applicator tip 26 and the first bearing 16.

With reference to FIG. 3, the middles M18 and M24 of the first and second windings 18 and 24 in the direction of the axis A1 and A2 of each of the windings 18 and 24 (the axes of the windings being aligned with the axes of the corresponding bearings and reels respectively) projecting into the axis of each winding, respectively, are offset in relation to one another in the direction Y perpendicular to the application plane P1. Thus, the first winding 18 and the second winding 24 are offset in relation to one another in the direction Y perpendicular to the application plane P1. More particularly, in this embodiment, the first winding 18 is offset in relation to the second winding 24 on the side of the first twisted surface 26B1 of the tip 26 while the second winding 24 is offset in relation to the first winding 18 on the side of the second twisted surface 26B2 of the tip 26.

Figure 2A:
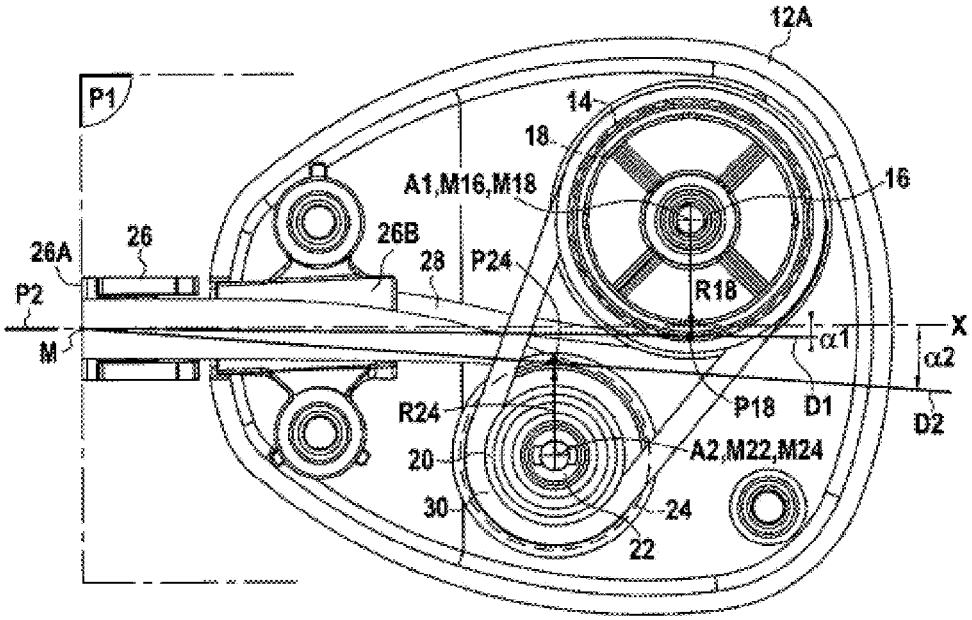
FIGS. 2A and 2B show the manual device seen along Arrow II in FIG. 1, according to the two different states of the windings of tape.
Figure 2B:
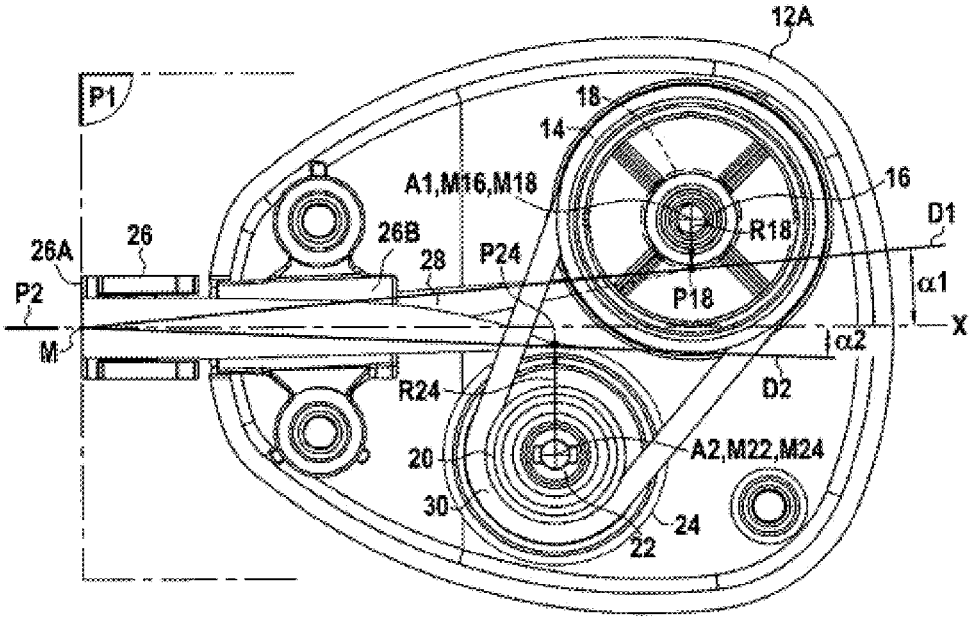

FIGS. 2A and 2B each represent a projection view on the application plane P1. In FIG. 2A, the manual device 10 is new, so that the first winding 18 has a maximum outer diameter while the second winding 24 has a minimum outer diameter. Conversely, in FIG. 2B, the manual device 10 is totally used up, so that the first winding 18 has a minimum outer diameter while the second winding 24 has a maximum outer diameter.

The first angle $\alpha 1$ is formed between the median plane P2 and the half-line D1 extending from the first middle M of the application edge 26A and passing through the point P18 arranged at the intersection of the outer periphery of the first winding 18 and the radius R18 of the first winding 18 perpendicular to the median plane P2. The second angle $\alpha 2$ is the angle between the median plane P2 and the half-line D2 extending from the middle M of the application edge 26A and passing through the point P24 arranged at the intersection of the outer periphery of the second winding 24 and the radius R24 of the second winding 24 perpendicular to the median plane P2. As can be seen in FIG. 3, the middle is taken in the direction of the axis of the windings 18 and 24 (i.e. the middle of the width L of the windings/tape) as the reference plane in order to choose points P18 and P24 on the outer periphery of the first and second windings 18 and 24.

In FIG. 2A, the half-line D1 extends from the side opposite to the first bearing 16 (that is to say, to point M16) in relation to the median plane P2. Consequently, the measurement of the angle α1 in FIG. 2A is negative. Conversely, in FIG. 2B, the half-line D1 extends from the same side as the first bearing 16 in relation to the median plane P2. Consequently, the measurement of the angle α1 in FIG. 2B is positive. In this embodiment, the half-line D2 is always arranged on the same side as the second bearing 22 (that is to say as point M22) in relation to the median plane P2, so that its measurement is always positive.

In this embodiment, in FIG. 2A, first winding 18 full, α1=−0.4° (minus four tenths of a degree of angle) whereas in FIG. 2B, first winding 18 empty, α1=8° (eight degrees of angle). Thus, the first angle α1 is always between −1° and 10°, whatever the state of the first winding 18 (i.e. full, empty or in an intermediate state between empty and full). In this embodiment, in FIG. 2A, second winding 24 empty, α2=6° (six degrees of angle) whereas in FIG. 2B, second winding 24 full, α2=1.4° (one and four tenths of a degree of angle). Thus, the second angle α2 is always between 1° and 10°, whatever the state of the second winding 24 (i.e. full, empty or in an intermediate state between empty and full). Thus, the tape 18 constantly has a certain alignment in the longitudinal direction X with the applicator tip 26.

Although the present disclosure has been described with reference to specific embodiments, it is obvious that modifications and changes can be made to these embodiments without departing from the general scope as defined by the claims. In particular, individual characteristics of the various embodiments shown/mentioned can be combined in additional embodiments. Consequently, the description and drawings must be considered in an illustrative rather than a restrictive sense.

The invention claimed is:

1. A manual device for applying a coating to a support by tape comprising a supply reel mounted on a first bearing and comprising a first tape winding, a take-up reel mounted on a second bearing and comprising a second tape winding, and an applicator tip to apply the coating carried by the tape onto a support, the applicator tip extending in a longitudinal direction and having an application edge, the application edge and the longitudinal direction defining an application plane while a plane perpendicular to the application plane and extending in the longitudinal direction and passing through a middle of the application edge forms a median plane of the applicator tip, in which an angle between axes of each of the first and second bearings and the application plane is greater than or equal to 30 degrees, wherein the first bearing and the second bearing are arranged on either side of the median plane of the applicator tip and, are considered projecting into the application plane, a first angle formed between the median plane and a half-line extending from the middle of the application edge and passing through a point arranged at an intersection of the outer periphery of the first winding and a radius of the first winding perpendicular to the median plane, is between −1 and 10 degrees whereas a second angle formed between the median plane and a half-line extending from the middle of the application edge and passing through a point arranged at the intersection of the outer periphery of the second winding and a radius of the second winding perpendicular to the median plane, is between 1 and 10 degrees, wherein the tape cooperates only with the supply reel, the take-up reel and the applicator tip.

2. A manual device for applying a coating to a support by tape according to claim 1, wherein the applicator tip comprises a guide portion having a first twisted surface and a second twisted surface, the first twisted surface cooperating with the tape downstream of the supply reel and upstream of the application edge while the second twisted surface cooperates with the tape downstream of the application edge and upstream of the take-up reel, the tape being configured to travel from upstream to downstream within the manual device.

3. A manual device for applying a coating to a support by tape according to claim 1, wherein the first bearing and the second bearing are offset in relation to one another in the longitudinal direction.

4. A manual device for applying a coating to a support by tape according to claim 3, wherein, considered in the longitudinal direction, the second bearing is arranged between the applicator tip and the first bearing.

5. A manual device for applying a coating to a support by tape according to claim 1, wherein the first winding and the second winding are offset in relation to one another in a direction perpendicular to the application plane.

6. A manual device for applying a coating to a support by tape according to claim 2, wherein the first winding is offset in relation to the second winding on the side of the first twisted surface whereas the second winding is offset in relation to the first winding on the side of the second twisted surface.

7. A manual device for applying a coating to a support by tape comprising a supply reel mounted on a first bearing and comprising a first tape winding, a take-up reel mounted on a second bearing and comprising a second tape winding, and an applicator tip to apply the coating carried by the tape onto a support, the applicator tip extending in a longitudinal direction and having an application edge, the application edge and the longitudinal direction defining an application plane while a plane perpendicular to the application plane and extending in the longitudinal direction and passing through a middle of the application edge forms a median plane of the applicator tip, wherein the first bearing and the second bearing are arranged on either side of the median plane of the applicator tip and, are considered projecting into the application plane, a first angle formed between the median plane and a half-line extending from the middle of the application edge and passing through a point arranged at an intersection of the outer periphery of the first winding and a radius of the first winding perpendicular to the median plane, is between −1 and 10 degrees whereas a second angle formed between the median plane and a half-line extending from the middle of the application edge and passing through a point arranged at the intersection of the outer periphery of the second winding and a radius of the second winding perpendicular to the median plane, is between 1 and 10 degrees, wherein the tape cooperates only with the supply reel, the take-up reel and the applicator tip.

8. A manual device according to claim 7, wherein the applicator tip comprises a guide portion having a first twisted surface and a second twisted surface, the first twisted surface cooperating with the tape downstream of the supply reel and upstream of the application edge while the second twisted surface cooperates with the tape downstream of the application edge and upstream of the take-up reel, the tape being configured to travel from upstream to downstream within the manual device.

9. A manual device according to claim 7, wherein the first bearing and the second bearing are offset in relation to one another in the longitudinal direction.

10. A manual device according to claim 9, wherein, considered in the longitudinal direction, the second bearing is arranged between the applicator tip and the first bearing.

11. A manual device according to claim 7, wherein the first winding and the second winding are offset in relation to one another in a direction perpendicular to the application plane.

12. A manual device according to claim 8, wherein the first winding is offset in relation to the second winding on the side of the first twisted surface whereas the second winding is offset in relation to the first winding on the side of the second twisted surface.

13. A device, comprising:

a first reel coupled to a first bearing and comprising a first tape winding;

a second reel coupled to a second bearing and comprising a second tape winding; and an applicator tip configured to apply a coating carried by a tape onto a support, the applicator tip extends in a first direction and has an edge that each defines an application plane;

the applicator tip further includes a median plane that is perpendicular to the application plane, extends in the first direction, and passes through a middle portion of the edge;

wherein the first bearing and the second bearing are arranged on either side of the median plane and project into the application plane;

wherein a first angle formed between the median plane and a line that extends from the middle portion of the edge, and that passes through a point arranged at an intersection of a periphery of the first tape winding and a radius of the first tape winding perpendicular to the median plane, is between −1 and 10 degrees; and wherein a second angle formed between the median plane and a line that extends from the middle portion of the edge, and that passes through a point arranged at an intersection of a periphery of the second tape winding and a radius of the second tape winding perpendicular to the median plane, is between 1 and 10 degrees, wherein the tape cooperates only with the first reel, the second reel and the applicator tip.

* * * * *